US005616297A

United States Patent [19]

Ebner et al.

[11] Patent Number: 5,616,297

[45] Date of Patent: Apr. 1, 1997

[54] ANNEALING BASE FOR HOOD-TYPE ANNEALING FURNACES

[76] Inventors: Peter H. Ebner, Bergham 168; Heribert Lochner, Burgwallstrasse 19, both of A-4060 Leonding, Austria

[21] Appl. No.: 604,056

[22] Filed: Feb. 22, 1996

[30] Foreign Application Priority Data

Feb. 24, 1995 [AT] Austria ..... 337/95

[51] Int. Cl.[6] ..... C21D 1/00

[52] U.S. Cl. ..... 266/263; 266/252

[58] Field of Search ..... 266/249, 252, 266/256, 262, 263

[56] References Cited

U.S. PATENT DOCUMENTS

| | | | |
|---|---|---|---|
| 2,504,809 | 4/1950 | Dailey, Jr. | 266/256 |
| 3,179,394 | 4/1965 | Sims et al. | 266/256 |
| 4,813,654 | 3/1989 | Singler | 266/262 |

*Primary Examiner*—Scott Kastler
*Attorney, Agent, or Firm*—Collard & Roe, P.C.

[57] ABSTRACT

An annealing base for hood-type annealing furnaces comprises a support (6) receiving the annealing goods, in particular stacked sheet metal coils. The support (6) rests on the distributor (4) of a central fan (5). The vertical fan axis is surrounded by a thermally insulating filling member (3). The load of the distributor (4) is transmitted by means of a supporting structure (9, 10) through the filling member (3) to a frame member (2) supported on the foundation (1). The filling member (3) consists of insulating wool or the like gas-tightly encapsulated in sheet metal. To avoid the formation of cracks in the filling member (3) during the annealing process, a stronger shaped ring (9) adapted to the bottom surface of the distributor (4) is inserted in the sheet metal constituting the capsule of the filling member (3), which shaped ring constitutes the supporting structure by means of two concentric sheet metal cylinders (10) connecting the same with the frame member (2).

2 Claims, 1 Drawing Sheet

ANNEALING BASE FOR HOOD-TYPE ANNEALING FURNACES

This invention relates to an annealing base for hood-type annealing furnaces comprising a support receiving the annealing goods, in particular stacked sheet metal coils, on the distributor of a central fan, a thermally insulating filling member disposed thereunder and surrounding the fan axis, and comprising a supporting structure transmitting the load from the distributor through the filling member to a frame member lying on the foundation, where the filling member consists of insulating wool or the like gas-tightly encapsulated in sheet metal.

When the annealing goods have been placed on the support, a protective hood reaching up to the frame member is placed over the annealing goods and the base, which protective hood contains a protective gas circulated by the fan, which chiefly serves to avoid oxidations on the surface of the annealing goods. The protective hood is then covered by a heating hood, whose heating means, in general gas or oil burners or electric heating elements, heats the protective hood on the outside, which protective hood in turn heats the protective gas and as a further consequence the annealing goods. Upon completion of the heat treatment the heating hood is replaced by a cooling hood, and the charge is cooled.

The supporting structure of the annealing base, which serves to dissipate the load of the weight of the annealing goods to the foundation, has so far chiefly consisted of individual, mostly tubular supports welded to the enveloping sheet metal, which supports have supporting elements in their upper portion, which absorb the changes in length occurring during heating or cooling between the upper enveloping sheet metal and the lower frame member by means of a sliding friction or bending stress acting on the supports, where relatively large dilatations or contractions occur, as the temperature difference between the distributor and the frame member is several hundred degrees. In the case of an improper construction or workmanship, cracks in the sheet metal capsule can already occur after a short operating time, so that an undesired mixing of the protective gas with the gas definitely present in the filling member, i.e. air or nitrogen, can occur. Such defects are chiefly due to the fact that a relative movement at the sliding surfaces is impaired, so that transverse forces are developed in the supports, which may cause welding cracks.

It is therefore the object of the invention to eliminate this deficiency and create an annealing base of the above-described type, where no cracks occur in the capsule constituting the filling member.

This object is solved by the invention in that in the sheet metal constituting the capsule of the filling member directly below the distributor a shaped ring adapted to the bottom surface of said distributor and of substantially greater thickness than the sheet metal is inserted, which constitutes the supporting structure by means of two concentric sheet metal cylinders connecting it with the frame member.

The two concentric sheet metal cylinders, which are mostly firmly welded with the shaped ring on the side of the annealing chamber, are subjected from the top to the same temperature as said shaped ring, so that all members are dilating uniformly, and there can be no differences in length or sliding movements between the individual members.

When the sheet metal cylinder and the shaped ring are heated, they are increased in diameter by the coefficients of thermal expansion corresponding to the respective materials, and then shrink again when they are cooled, without a risk of producing welding cracks or the like. Since the insulating wool or the like contained in the filling member is elastic, there is not produced an opening between the metal parts and the insulation material during said processes, which opening would provide for a transport of heat from the top into the lower base portion toward the foundation as a result of natural gas flows.

In a further embodiment of the invention the lower edge of the sheet metal cylinder comprises recesses and is welded with the frame member only between said recesses. As a result, the conduction of heat inside the sheet metal ring from the top to the frame member is reduced considerably, as the recesses prevent such thermal conduction.

In the drawing, the subject-matter of the invention is illustrated by way of example, wherein:

Figure 1:
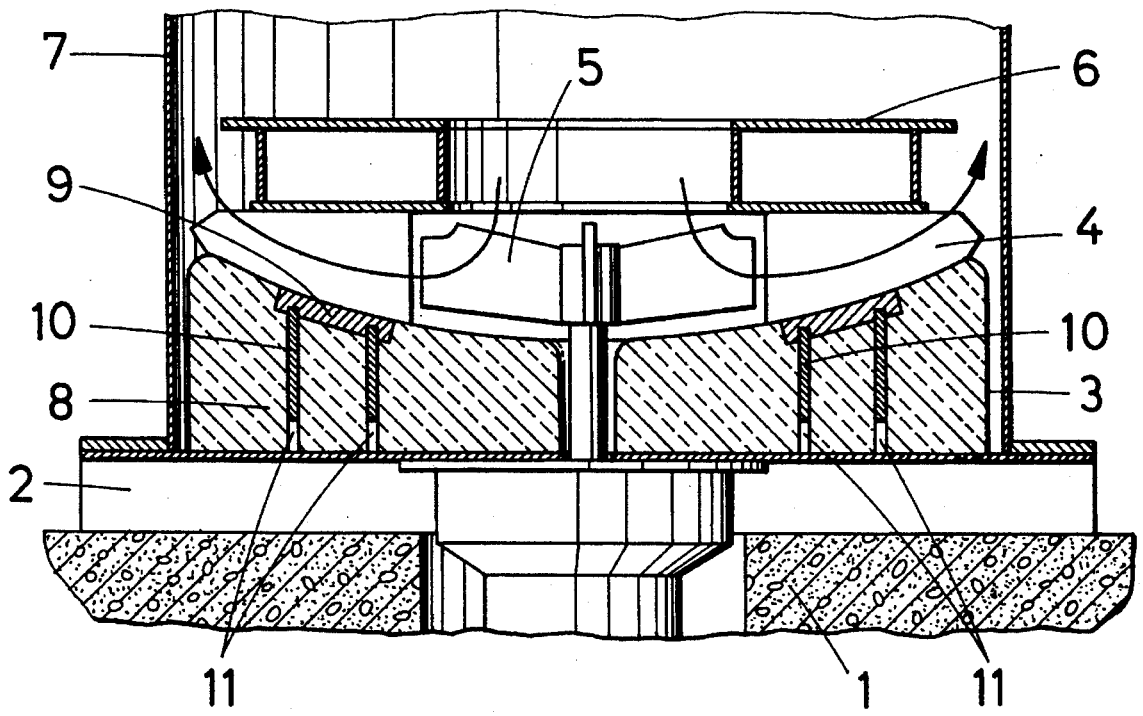
FIG. 1 represents a vertical section of an annealing base.

On the foundation 1 a frame member 2 is supported, which in turn carries filling members 3. On the filling members 3 the distributor 4 of a central fan 5 is supported, with the distributor in turn carrying a support 6 for the annealing goods, in general sheet metal coils. Over the entire annealing base an annealing hood 7 is placed.

For transmitting the load of the annealing goods from the support 6 to the foundation 1 there is first of all provided the distributor 4. In the filling member 3, which consists of a gas-tight sheet metal capsule and is filled with insulating wool 8, a supporting structure is disposed for transmitting the load to the frame member 2.

Figure 2:
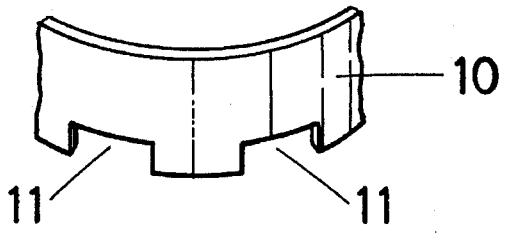
FIG. 2 is a graphical representation of a part of a sheet metal cylinder.

This supporting structure consists of a relatively strong shaped ring 9 adapted to the bottom surface of the distributor 4 and inserted in the sheet metal of the filling member 3, which shaped ring is connected with the frame member 2 by two concentric sheet metal cylinders 10, which are welded both with the frame member 2 and with the shaped ring 9. From FIG. 2 it can be seen that the sheet metal rings 10 have recesses 11 at their lower edge and can therefore be welded with the frame member only between said recesses 11.

We claim:

1. An annealing base for an annealing furnace, the annealing base being covered by a hood and comprising (a) a frame member supported on a foundation and supporting the hood, (b) a central fan comprising a vertical shaft and a distributor, the distributor having a bottom surface, (c) a support for goods to be annealed, the support being positioned on the distributor, (d) a filling member arranged between the distributor and the frame member, the filling member comprising (1) a thermally insulating wool surrounding the vertical shaft of the central fan and gas-tightly encapsulated in sheet metal, and (e) a load-transmitting supporting structure between the distributor and the frame member, the supporting structure comprising (1) a shaped ring inserted directly below the distributor in the sheet metal gas-tightly encapsulating the thermally insulating material, the shaped ring conforming in shape to the bottom surface of the distributor and being of a much greater thickness than the sheet metal, and (2) two concentric sheet metal cylinders connecting the shaped ring to the frame member.

2. The annealing base of claim 1, wherein the sheet metal cylinders have lower edges defining spaced recesses, the lower edges being welded to the frame member between the recesses.

* * * * *